US006015446A

United States Patent [19]

Rochl

[11] Patent Number: 6,015,446

[45] Date of Patent: Jan. 18, 2000

[54] PM HOT-WORK STEEL AND METHOD OF PRODUCING THE SAME

[75] Inventor: Maximilian Rochl, Munich, Germany

[73] Assignee: Hanspeter Hau, Baldham, Germany

[21] Appl. No.: 09/011,792

[22] PCT Filed: Jun. 16, 1997

[86] PCT No.: PCT/EP97/03119

§ 371 Date: Apr. 16, 1998

§ 102(e) Date: Apr. 16, 1998

[87] PCT Pub. No.: WO97/48829

PCT Pub. Date: Dec. 24, 1997

[30] Foreign Application Priority Data

Jun. 17, 1996 [EP] European Pat. Off. ..... 96109706

[51] Int. Cl.[7] ..... C22C 33/00

[52] U.S. Cl. ..... 75/243; 75/246; 419/11; 419/49

[58] Field of Search ..... 75/243, 246; 419/11, 419/49

[56] References Cited

U.S. PATENT DOCUMENTS

| | | | |
|---|---|---|---|
| 4,923,671 | 5/1990 | Aslund | 419/8 |
| 5,435,824 | 7/1995 | Dorsch et al. | 75/231 |
| 5,435,827 | 7/1995 | Wisell | 75/236 |
| 5,447,800 | 9/1995 | Dorsch et al. | 428/552 |
| 5,522,914 | 6/1996 | Stasko et al. | 75/231 |

FOREIGN PATENT DOCUMENTS

| | | |
|---|---|---|
| 0 467 857 | 1/1992 | European Pat. Off. . |
| 1590953 | 6/1981 | United Kingdom . |

OTHER PUBLICATIONS

Wegst C.W. "Stahlschluessel" 1989, Stahlschlussel, Nachschlagewerk, NR. ED. 1989, pp. 237/238, 242, Wegst C W XP002019003.

*Primary Examiner*—Ngoclan Mai
*Attorney, Agent, or Firm*—Flynn, Thiel, Boutell & Tanis, P.C.

[57] ABSTRACT

A powder-metallurgically produced hot-work steel consists (in weight percent) of: 0.25–0.45 carbon, 2.40–4.25 chromium, 2.50–4.40 molybdenum, 0.20–0.95 vanadium, 2.10–3.90 cobalt, 0.10–0.80 silicon, 0.154–0.65 manganese, the balance being iron and possibly impurities resulting from production. The powder charge with the above-mentioned composition is simultaneously exposed to high compacting pressures and high compacting temperatures in a hot isostatic press.

6 Claims, 2 Drawing Sheets

PM HOT-WORK STEEL AND METHOD OF PRODUCING THE SAME

PRIOR ART

Figure 1:
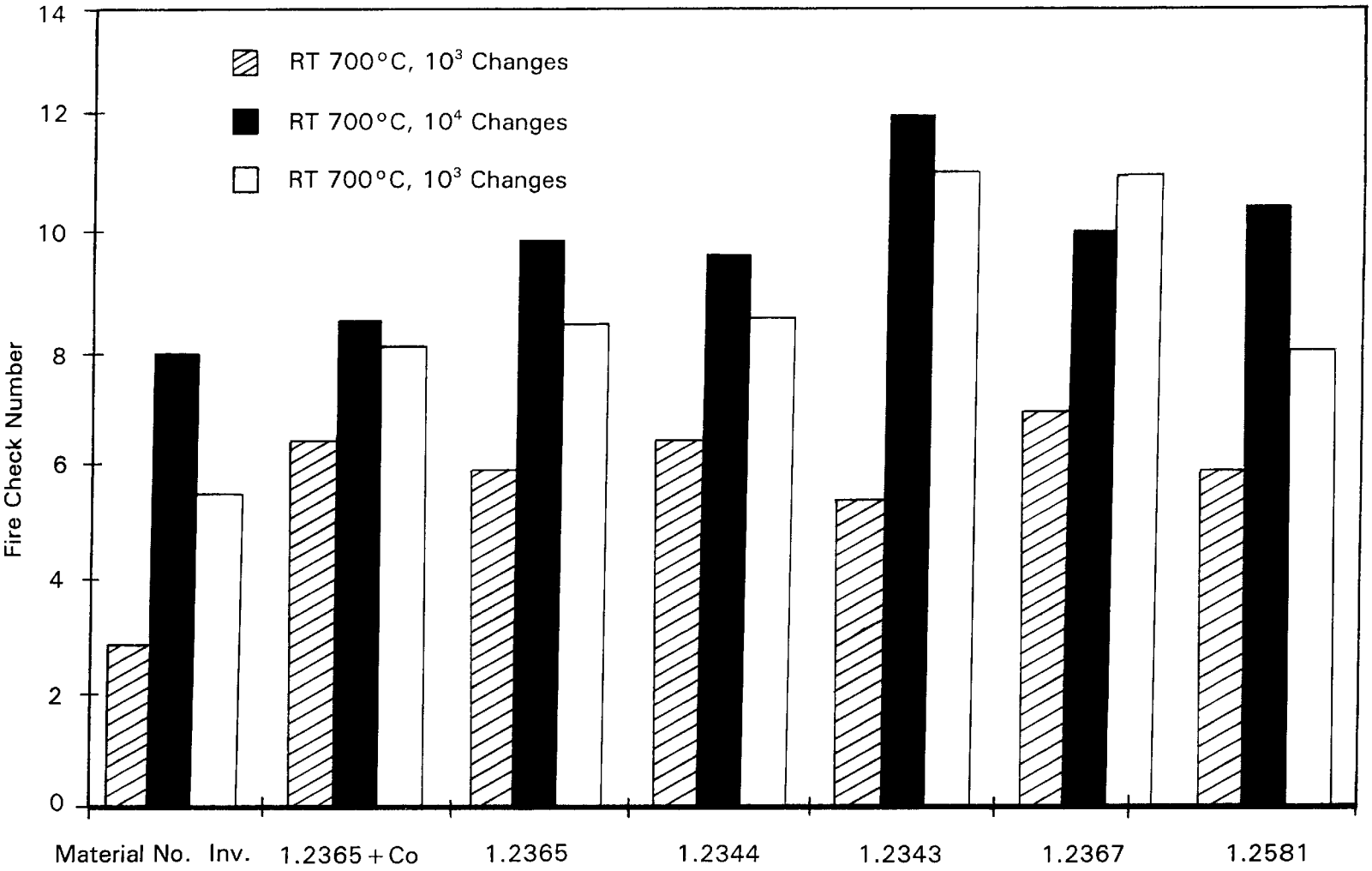

It has been known for a long time that powder-metallurgically produced steels have characteristics which are superior to those of an identical composition of melt-metallurgically produced steels. In particular, powder-metallurgically produced steels are characterized by the feature that in all dimensional ranges they exhibit the same microstructural state over their whole cross-section. Hence, the mechanical characteristics are substantially the same over the whole cross-section.

It has already been known that the hot-work steel X40CrMoV51 is produced in a powder-metallurgical process by hot isostatic pressing. As can be gathered from the "Archiv für das Eisenhüttenwesen" ("Archives for Iron Metallurgy") 55 (1984), pages 169–176, the said hot-work steel contains carbon of 0.37 to 0.41%, silicon of 1.0 to 1.07%, manganese of 0.38 to 0.42%, chromium of 5.3 to 5.5%, molybdenum of 1.37 to 1.41%, vanadium of 1.0 to 1.27% and negligible amounts of nitrogen, oxygen, sulfur and phosphorus.

A powder of the above-stated composition, which has been produced by nitrogen atomization from the melt, is compacted in steel capsules which, prior to being closed, are evacuated to a vacuum of less than $10^{-4}$ mbar. Compacting is carried out at temperatures of from 1075° C. to 1225° C.

Although the above-mentioned powder-metallurgically produced hot-work steel has an adequate hardness, it is not suited for highly stressed hot-work tools, such as pressing mandrels, pressing dies and containers for metal-tube extrusion or for extrusion, nor for hot extrusion tools, tools for making hollow bodies, tools for screw, nut, rivet and bolt products, die-casting tools, press dies for shaped parts, die inserts or hot shear blades because of its insufficient hot hardness and its lack of good tempering properties and because of its tendency to cracking caused by temperature changes. In short, the stability of the steel in question is not satisfactory in the case of highly stressed hot-work tools.

It is therefore the object of the present invention to provide a powder-metallurgically produced hot-work steel which, apart from a sufficient degree of toughness, has a high hot hardness and, in particular, a high resistance to cracking caused by temperature changes. To be more specific, it is the object of the present invention to provide a powder-metallurgically produced hot-work steel which is particularly suited for use in extrusion processes, in particular for pressing mandrels, pressing dies and containers, and is also suited for use in forging presses and die-casting dies, particularly in the case of large dimensions.

Furthermore, it is the object of the invention to provide a method of producing an improved powder-metallurgically produced hot-work steel.

As for the steel to be produced, this object is achieved by the subject matter of claim 1. As for the method to be created, this object is achieved by the subject matter of claim 5.

Furthermore, the invention relates to the use of the powder-metallurgically produced hot-work steel as a material for producing pressing mandrels, pressing dies and containers for extrusion and for producing forging presses and die-casting dies.

The technical progress which can be achieved with the aid of the invention is primarily due to the fact that as a consequence of the inventive cobalt-containing composition, synergetically enhanced by the special compaction according to the invention, a powder-metallurgically produced hot-work steel is provided which essentially has the same good hot-ductility characteristics as a known cobalt-free hot-work steel, but, in addition, has high hot-hardness and temper values, as well as high resistance values regarding fire check.

Among the experts, there are strong objections to the inclusion of cobalt in a hot-work steel. To be more specific, there prevails the idea among the experts that the addition of cobalt to an alloy will certainly not yield or even improve the toughness characteristics, in particular hot ductility characteristics, of a powder-metallurgically produced hot-work steel.

Preferred embodiments and further developments of the invention are indicated in the subclaims.

Both in the conventional powder-metallurgical production and in the production of the invention, high-value scrap and ferroalloys are the raw material. However, while the prior art avoids cobalt in powder-metallurgically produced hot-work steels, cobalt is contained in the present invention. Both in the prior art and the present invention, the starting alloys are preferably molten in an induction furnace.

Induction heat and an exact temperature control are employed for producing the steels of the invention until the slag content is correct. Subsequently, atomization is carried out under a protective atmosphere (preferably high-purity nitrogen). To this end, the APM calidus system has turned out to be particularly suited, as inclusions are avoided in the prepared powder with the aid of said system.

In the prior art efforts have been made to achieve a high purity degree of the melt by heating the melt through a slag cover with the aid of electrodes.

In the conventional method, the melt is directly atomized into the capsule to be compacted, which enhances the risk of undesired inclusions.

During production of the inventive steel, the resulting alloyed powder is filled into capsules which are designed such that the final product is given its intended shape at a maximum material yield. Hence, capsules which are to provide the product to be produced with its desired shape, at least to a large degree, are used according to the invention.

After the filling operation, the capsules are shaken to achieve a maximum filling density. The capsules filled in this manner are subsequently evacuated by a pump and then closed in a gas-tight manner.

As already stated, in the conventional method, atomization is directly carried out in capsules which are then welded in a gas-tight manner. The prior art is basically aware of only one standard capsule size with a diameter of 465 mm and a length of 1600 mm.

In conventional methods, the capsule which has been pretreated in the above-mentioned manner is subjected to cold isostatic pressing at a pressure of about 3.5 kbar to improve the thermal conductivity of the powder charge contained in the capsule.

Such a cold pressing operation is not required for the production of the hot-work steel according to the invention, since the powder charge already has such a high filling density due to shaking that the desired thermal conductivity characteristics are found in the powder charge.

In conventional methods, the above-described capsules are heated in a preheating furnace without overpressure to the temperature of hot isostatic pressing (HIP temperature)

and are then transported into the hot pressing installation. Since the thermal conductivity of the powder charge is just low, even after conventional cold pressing, a steep temperature gradient is obtained in the powder charge at the beginning of the preheating treatment, with the gradient leading to segregations of oxygen, sulfur and carbon. Such segregations have a considerable extent, which can be demonstrated by deep etchings or by chemical analysis. Furthermore, the steep temperature gradient leads to a certain carbide growth.

When the hot-work steels according to the invention are produced, the capsules are not preheated and, as already mentioned, there is also no cold pressing operation.

In the production according to the invention, the capsules are heated under simultaneous pressurization. In particular, pressurization is performed in a first step at about 200 bar with the aid of compressed argon. Subsequently, heating is performed in the HIP system, with the pressure of the compressed-argon supplying compressors being maintained at a substantially constant level. With an increasing temperature, the pressure will continuously rise without requiring an increase in the pressure of the argon compressors. The powder charge is compacted under pressure at a relatively low temperature before oxygen, sulfur and carbon are transported. As a consequence, the hot-work steel of the invention is free from segregations.

When the intended HIP pressure has been reached, a further rise in pressure or temperature will be prevented by taking suitable control measures.

The HIP temperature is 1000° C. to 1230° C., with a temperature of 1150° C. being preferred. The HIP pressure is 0.8 to 3.5 kbar, with a HIP pressure of 1 kbar turning out to be extremely advantageous at the moment. At pressures of less than 0.8 kbar, the material will not be compacted to a sufficient degree, and there will particularly be the risk that gas inclusions remain entrapped in residual pores. HIP pressures of more than 3.5 kbar are possible with modem HIP installations, but do not entail any quality enhancement that would justify the efforts taken.

In the steel production according to the invention, the holding time is at least 3 h at the desired HIP temperature and the desired HIP pressure. This period of time applies to small dimensions to be made. Large dimensions to be made require long compaction periods. As a rule, conventional methods employ holding times of just one single hour. Since filled capsules are simultaneously subjected to high temperatures and high pressures in the method according to the invention, a homogeneous material of a high density is achieved as the result.

The hot-work steel produced in a powder-metallurgical manner in a conventional way requires final forging or rolling treatments. Such processing measures which are taken under heat lead to an undesired carbide growth and, in addition, to an undesired rounding off of the carbides.

In contrast to the prior art, the hot-work steel which is composed and produced according to the invention is used in its hipped state, i.e. in the state in which it has been freed from the capsule after pressing. For economic reasons, however, round material according to the invention with diameters of less than 60 mm is flat-rolled or -forged, and also flat material with a cross-sectional ratio.

As far as quality control is concerned, it should be noted that in conventional methods a checking, for instance, for inclusions is not performed before the removal of the powder charge from the deformed capsule. By contrast, the steel material of the invention is already subjected to a critical quality control in its powder state.

The hot-work steel produced in a powder-metallurgical manner according to the invention has the following composition (in weight percent):

carbon: 0.25–0.45
chromium: 2.40–4.25
molybdenum: 2.50–4.40
vanadium: 0.20–0.95
cobalt: 2.10–3.90
silicon: 0.10–0.80
manganese: 0.15–0.65 the balance being iron and possibly impurities resulting from production. A purity degree of K 1<10 $\mu$m is preferred.

As regards the steel of the invention, the hot forming temperature is 900° C. to 1100° C., the soft-annealing temperature is 750° C. to 800° C., the stress relief temperature is 600° C. to 650° C., and the hardening temperature is 1000° C. to 1070° C. Oil in a hot bath (500° C. to 550° C.) is preferably used as the hardening agent. After soft annealing the hardness BH is 229 at the most. After hardening, the Rockwell hardness is 52 to 56 (RHC).

The PM hot-work steel according to the invention has the following, surprisingly good values at elevated temperatures (standard values):

1. Resistance to Heat

| Tempering Strength 1600 N/mm$^2$ | | | | | | | |
|---|---|---|---|---|---|---|---|
| Tensile Strength N/mm$^2$ | | | | Load at the 0.2% Elongation Yield N/mm$^2$ | | | |
| 400° C. | 500° C. | 600° C. | 650° C. | 400° C. | 500° C. | 600° C. | 650° C. |
| 1380 | 1210 | 950 | 760 | 1150 | 1000 | 750 | 630 |

2. Hot Hardness

| Working hardness 46 RHC; kept at test temperature for 30 min | | |
|---|---|---|
| 500° C. | 600° C. | 700° C. |
| 390 VH | 330 VH | 160 VH |

3. Hardness (RHC) After Tempering at Various Temperatures

| | Tempering temperat. in ° C. | | | | | | | | |
|---|---|---|---|---|---|---|---|---|---|
| | 100 | 200 | 300 | 400 | 500 | 550 | 600 | 650 | 700 |
| Rockwell hardness RHC | 54 | 53 | 50 | 52 | 52 | 53 | 52 | 47 | 46 |

4. Resistance to Fatigue Caused by Temperature Changes

Resistance of the material according to the invention to the occurrence of cracks as a result of frequent temperature changes was determined in a conventional manner in a laboratory. The material is cyclically heated to a test temperature and again cooled in an emulsion. Subsequently, the resultant cracks are counted over a given measurement length. The fire check number determined in this manner furnishes information on the behavior of the tested material in comparison with the behavior of a comparative material.

FIG. 1 shows the results of such fire check number investigations which were obtained with the material of the invention and with six comparative materials a) at a test temperature of 700° C. and $10^3$ temperature changes;

b) at a test temperature of 700° C. and $10^4$ temperature changes, and c) at a test temperature of 750° C. at $10^3$ temperature changes.

The tested materials had a strength of 47 RHC after tempering.

The comparative materials are designated with their material numbers "steel key". These comparative materials are steels produced by melt metallurgy. The most advantageous, i.e. lowest, fire check numbers are obtained for the inventive hot-work steel for all test conditions a) through c). The cobalt-containing comparative steel with the material number 1.2365+Co has considerably increased fire check numbers under all three test conditions a) through c). As for test condition a), the values determined with the comparative material 1.2365+Co are even higher by almost 100%.

5. Hot Ductility

Figure 2:
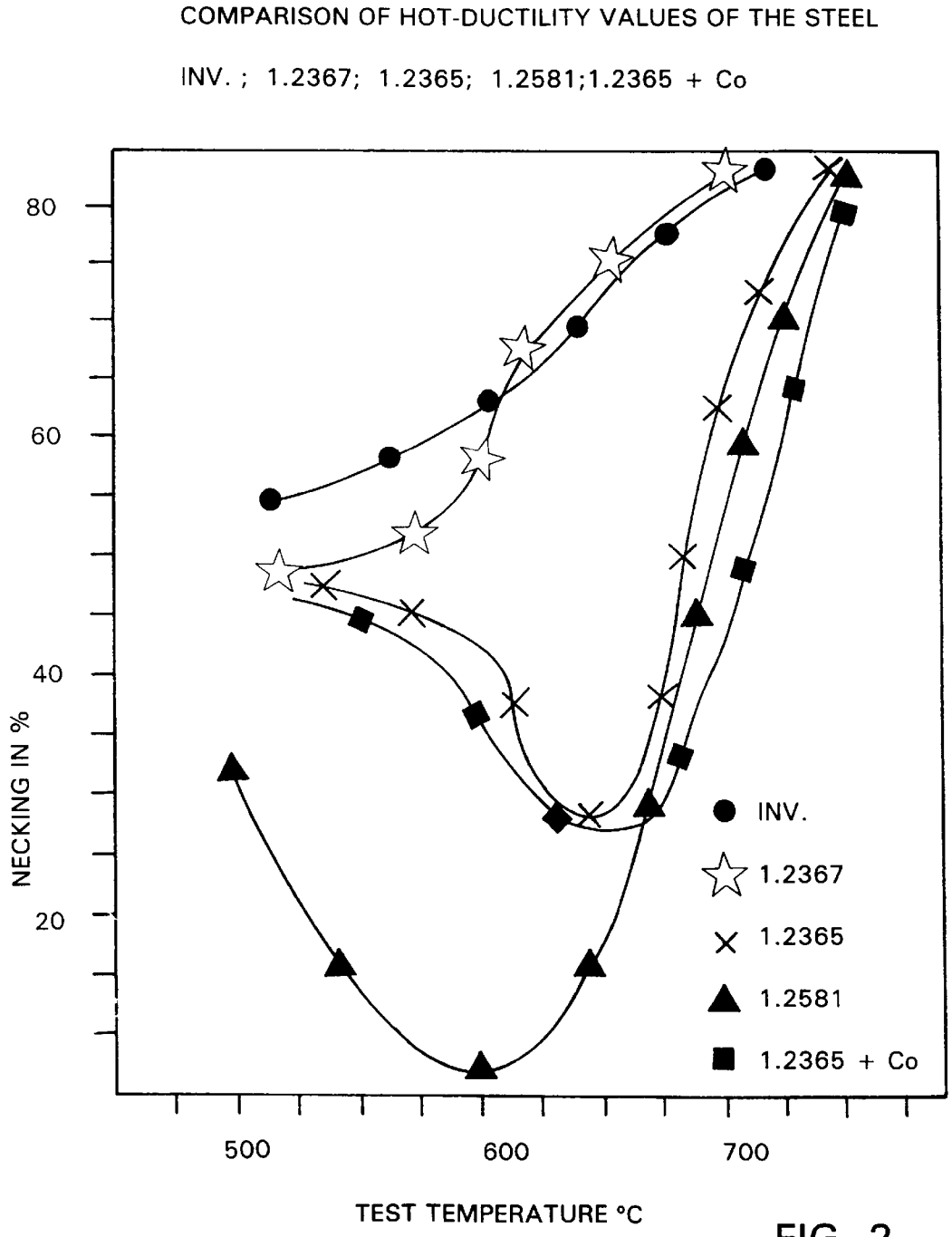

The excellent hot ductility values of the inventive material are graphically compared in FIG. 2 with the values determined with the indicated comparative materials. The material of the invention shows excellent necking results in the tested temperature range of about 600° C. to about 800° C. The comparative material with the material number 1.2365+Co, which also contains cobalt, turns out to be clearly inferior with respect to hot ductility.

I claim:

1. A powder-metallurgically produced hot-work steel consisting (in weight percent) of:

carbon: 0.25–4.45
chromium: 2.40–4.25
molybdenum: 2.50–4.40
vanadium: 0.20–0.95
cobalt 2.10–3.90
silicon: 0.10–0.80
manganese: 0.15–0.65 the balance being iron and possibly impurities resulting from production.

2. A PM hot-work steel according to claim 1, characterized by a purity degree K1 of less than 10 $\mu$m.

3. A PM hot-work steel according to claim 1, which can be produced by taking the following steps:

producing a steel melt with the desired chemical composition, atomizing the melt under a high-purity nitrogen atmosphere to form a resulting powder, filling the resulting powder into capsules which are designed such that the final product is given its intended shape at a maximum material yield, shaking the filled capsules for achieving a maximum filling density, evacuating the filled capsules and closing the same in a gas-tight manner, introducing the capsules into a hot isostatic press and simultaneously subjecting the capsules to pressure and heat until a pressure of 0.8 to 3.5 kbar and a temperature of 1000° C. to 1230° C. are reached, and maintaining the pressure and temperature for a period of at least 3 h.

4. A PM hot-work steel according to claim 3, characterized in that the powder charge has been subjected in the hot isostatic press to a pressure of 1 kbar.

5. A method for the powder-metallurgical production of a hot-work steel, comprising the following steps:

producing a steel melt with 0.25–0.45% carbon,
2.40–4.25% chromium,
2.50–4.40% molybdenum,
0.20–0.95% vanadium,
2.10–3.90% cobalt,
0.10–0.80% silicon,
0.15–0.65% manganese, the balance being iron and unavoidable accompanying elements, atomizing the melt under a high-purity nitrogen atmosphere to form a resulting powder, filling the resulting powder into capsules which are designed in such a manner that the final product is given its intended shape at a maximum material yield, shaking the filled capsules for achieving a maximum filling density, evacuating the filled capsules and closing the same in a gas-tight manner, introducing the capsules into a hot isostatic press and heating the capsules under simultaneous pressurization to a temperature of 1000° C. to 1230° C. and at a pressure of 0.8 to 3.5 kbar, and holding the charge at the selected temperature and the selected pressure for a period of at least 3 h.

6. A method of fabricating an article selected from the group consisting of a pressing mandrel, a pressing die, a container for extrusion, a forging press and a die-casting die comprising the step of forming the article out of a powder-metallurgically hot-work steel consisting of, in weight percent:

carbon: 0.25–0.45
chromium: 2.40–4.25
molybdenum: 2.50–4.40
vanadium: 0.20–0.95
cobalt: 2.10–3.90
silicon: 0.10–0.80
manganese: 0.15–0.65 and the balance being iron and possibly impurities resulting from production.

* * * * *

UNITED STATES PATENT AND TRADEMARK OFFICE

CERTIFICATE OF CORRECTION

PATENT NO. : 6,015,446
DATED : January 18, 2000
INVENTOR(S) : Maximillan Rochl

It is certified that error appears in the above-identified patent and that said Letters Patent is hereby corrected as shown below:

Column 5, line 29; change "carbon 0.25-4.45" to ---carbon 0.25-0.45---.

Signed and Sealed this

Second Day of January, 2001

*Attest:*

*Attesting Officer*

Q. TODD DICKINSON

*Commissioner of Patents and Trademarks*